US008795777B2

(12) United States Patent
Sanders et al.

(10) Patent No.: US 8,795,777 B2
(45) Date of Patent: Aug. 5, 2014

(54) MINE SHAFT LINER PLATE SYSTEM AND METHOD

(75) Inventors: Darrell J. Sanders, Mason, OH (US); Vernon B. Cameron, Mason, OH (US); Mark J. Swarny, Buena Vista, CO (US)

(73) Assignee: Contech Engineered Solutions LLC

( * ) Notice: Subject to any disclaimer, the term of this patent is extended or adjusted under 35 U.S.C. 154(b) by 0 days.

(21) Appl. No.: 13/407,356

(22) Filed: Feb. 28, 2012

(65) Prior Publication Data

US 2012/0213590 A1 Aug. 23, 2012

Related U.S. Application Data

(63) Continuation-in-part of application No. 13/019,372, filed on Feb. 2, 2011.

(60) Provisional application No. 61/394,800, filed on Oct. 20, 2010, provisional application No. 61/369,856, filed on Aug. 2, 2010, provisional application No. 61/301,316, filed on Feb. 4, 2010.

(51) Int. Cl.

| | |
|---|---|
| ***B05D 3/12*** | (2006.01) |
| *B29C 65/00* | (2006.01) |
| *B32B 37/00* | (2006.01) |
| *B32B 38/10* | (2006.01) |
| *E02D 29/00* | (2006.01) |
| *E21D 9/00* | (2006.01) |
| *E21D 11/00* | (2006.01) |
| *B63B 35/03* | (2006.01) |
| *B63B 35/04* | (2006.01) |
| *F16L 1/024* | (2006.01) |

(52) U.S. Cl.
USPC ..... 427/290; 156/153; 405/132; 405/154.1; 405/152

(58) Field of Classification Search
USPC ..... 427/290; 156/153; 405/132, 154.1, 152
See application file for complete search history.

(56) References Cited

U.S. PATENT DOCUMENTS

| | | | | |
|---|---|---|---|---|
| 3,695,044 | A * | 10/1972 | Hoshino et al. | 405/152 |
| 4,824,289 | A * | 4/1989 | Glang et al. | 405/152 |
| 5,171,818 | A * | 12/1992 | Wilson | 528/59 |
| 5,172,919 | A | 12/1992 | Takasaki et al. | |
| 2007/0289966 | A1 * | 12/2007 | Morrison et al. | 220/62.22 |

FOREIGN PATENT DOCUMENTS

| | | |
|---|---|---|
| DE | 1658716 | 11/1970 |
| DE | 2642104 | 3/1978 |
| GB | 2069569 | 8/1981 |
| WO | WO 2007/019812 | 2/2007 |

OTHER PUBLICATIONS

PCT/US2011/023290, International Search Report and Written Opinion; Mailed Feb. 20, 2012.

* cited by examiner

*Primary Examiner* — Kelly M Gambetta
(74) *Attorney, Agent, or Firm* — Thompson Hine LLP

(57) ABSTRACT

A liner plate structure, system and method is provided for lining of mine shaft bores, tunnels and the like. The liner plate structure includes a primary plate portion and at least one flange disposed at a side edge of the primary plate portion. A polymer seal element extends along a recess within an exterior surface of the flange.

16 Claims, 19 Drawing Sheets

MINE SHAFT LINER PLATE SYSTEM AND METHOD

CROSS-REFERENCES

This application is a continuation-in-part of U.S. application Ser. No. 13/019,372, filed Feb. 2, 2011, and also claims the benefit of U.S. Provisional Application Ser. Nos. 61/301,316, filed Feb. 4, 2010, 61/369,856, filed Aug. 2, 2010 and 61/394,800 filed Oct. 20, 2010, the entire specification of each of which is incorporated herein by reference.

TECHNICAL FIELD

This application relates generally to liner systems for vertical mine shafts and underground tunnels and, more particularly, to liner plate system and method for providing a waterproof shaft or tunnel.

BACKGROUND

Vertical mine shafts often encounter issues with water penetration, particularly when one or more vertical sections of the mine shaft pass through porous ground water containing layers. Prior attempts to address this issue include cast iron tubbing, welded steel panels, composite bolted systems and others. However, such technologies have proven expensive and timely to install.

Accordingly, it would be desirable and advantageous to provide a system and method of sealing vertical mine shafts and other types of tunnels that facilitates installation.

SUMMARY

In one aspect, a liner plate structure for use in lining shafts and tunnels includes a primary plate portion and at least one flange disposed at a side edge of the primary plate portion. A recess extends along the exterior surface of the flange and holds a seal element that is bonded to at least a bottom surface of the recess. The seal element is formed by a polymeric material applied by a plural component processing technique.

In another aspect, a liner plate structure for use in lining shafts and tunnels includes a primary plate portion having a length and height, the length greater than the height, the primary plate portion further including first, second, third and fourth side edges. First, second, third and fourth flanges respectively disposed at the first, second, third and fourth side edges, each flange having a plurality openings therein for facilitating connection to another liner plate structure. Each flange includes a respective recess that is aligned with the recess of adjacent flanges to produce a continuous recess that circumscribes the line plate structure. A continuous, seamless seal structure extends along the continuous recess and is formed by a polymeric material, where the seal structure is bonded to at least a portion of the recess.

In yet another aspect, a method of forming a plate structure for use in lining shafts and tunnels involves: utilizing a liner plate structure with a primary plate having first, second, third and fourth flanges respectively disposed at first, second, third and fourth side edges of the primary plate, each flange including a respective recess that is aligned with the recess of adjacent flanges to produce a continuous recess that circumscribes the liner plate structure; applying a seal member to the continuous recess utilizing a plural component material processing technique and in a manner such that the seal member is bonded to a portion of the recess and includes an upper portion protruding from the recess.

DETAILED DESCRIPTION

Figure 1:
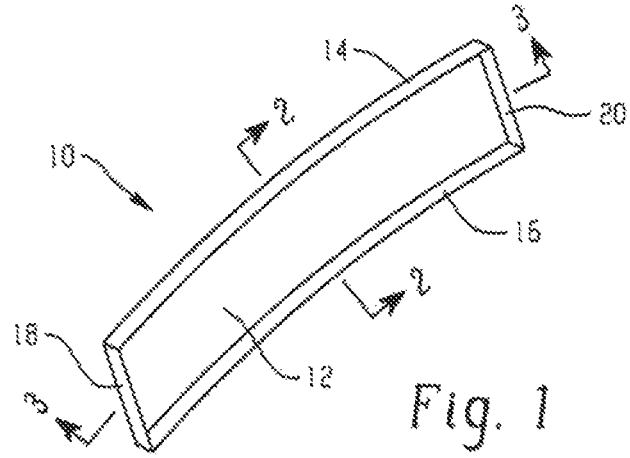
FIG. 1 illustrated one embodiment of a liner plate structure.

Referring to FIG. 1 an exemplary liner plate 10 is shown and includes a primary plate portion 12 of arcuate (or other curvature) configuration with peripheral top, bottom, left and right side flanges 14, 16, 18 and 20 located at respective side edges of the plate portion. The plate and flanges are preferably formed primarily of a strong material such structural carbon steel or aluminum. To form the liner plate a generally flat piece of plate material may be curved into an arcuate shape and generally flat pieces of flange material may be formed or cut into corresponding arcuate shapes. It is recognized that corrugations could be incorporated into plate portion 12 for increased strength and/or inwardly facing vertical or lateral ribs could be formed in or applied to the plate portion 12 for increased strength. The top and bottom arcuate flange portions may then be welded to the arcuate plate portion. Left and right side flange portions may then be welded to plate ends as well. Any suitable metal welding technology may be used. In another embodiment, the flat plate could be cut to include the flange portion (e.g., by removing corner sections), the flange portions folded relative to the base plate portion, the structure formed into an arcuate shape and then the flange portions welded to each other at the corners. In still other embodiments a stamping operation, forging operation or metal casting operation may be used to form the liner plate. Alternatively, a material other than steel or other alloy is used, such as concrete, in which case the liner plates may be formed by casting.

The dimensions of the liner plate may vary depending upon the size of the mine shaft or tunnel into which the liner plates will be assembled, as well as other factors. However, it is contemplated that the thickness of the plate portion 12 may generally be in the range of about ¼" to 1" or more (e.g., such as in the range of about 2" to 5"). In applications where the liner plate is installed to provide structural support for the shaft or tunnel wall, the plate thickness may be higher. The arcuate length or extent of a typical liner plate may be in the range of about 36" to 72" or more, such as up to about 216" and the arc encompassed by that length may typically be in the range of about 18 to 36 degrees or more (e.g., such as about 40 to 180 degrees). The height of each liner plate may typically be in the range of about 24" to 36" or more (e.g., such as between about 42" to 96"). The radial depth of the liner plates may be in the range of about 5" to 10" or more (e.g., such as in the range of about 10" to 18"). Variations on these dimensions are possible. In some embodiments, the thickness of the flanges 14, 16, 18 and 20 will match that of the arcuate plate 12. In other embodiments the thickness of the flanges may be more or less than that of the arcuate plate.

Figure 2A:
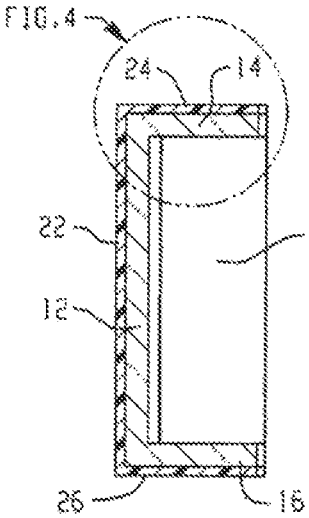
FIG. 2A shows one embodiment of a cross section of the liner plate of FIG. 1 along line 2-2.
Figure 2B:
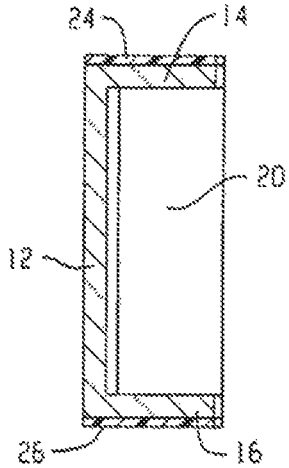
FIG. 2B shows another embodiment of a cross-section of the liner plate of FIG. 1 along line 2-2.
Figure 3:
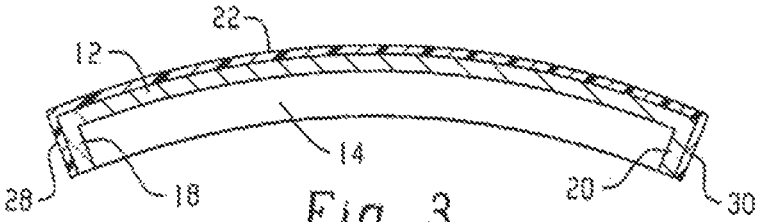
FIG. 3 shows a cross-section of the liner plate of FIG. 1 along line 3-3.

Referring to FIGS. 2A and 2B, exemplary cross-sections of the liner plate 12 are shown. FIG. 2A shows a cross-section in which the outer surface of each of the arcuate plate 12 and top and bottom flange 14 and 16 has a polypropylene layer 22, 24 and 26 bonded thereto. Other suitable thermoplastics that can be thermally bonded could be used to form the layers, such as polyethylene. In order to form a continuous polypropylene layer it may be applied after the plate and flanges are formed and welded. However, embodiments in which the polypropylene layer is coated onto the plate and flanges prior to the components being welded together may be possible. FIG. 2B shows an embodiment in which only the top and bottom flanges 14 and 16 include a polypropylene layer. In either implementation (FIG. 2A or FIG. 2B), both the left and right flanges 18 and 20 would include corresponding polypropylene layers 28 and 30 as well as shown in FIG. 3. By way of example, the polypropylene layers may typically have a thickness in the range of about ⅛" to ½", but variations are possible. The primary purpose of the polypropylene layers is to provide a sealing function when liner plates are abutted against each other and assembled into a cylindrical liner for a mine shaft or tunnel.

Figure 5A:
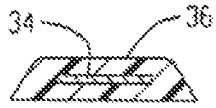
FIGS. 5A-5C show alternative fusion chord configurations in cross-section.
Figure 5B:
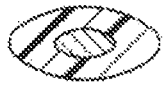
Figure 5C:
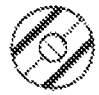
Figure 4:
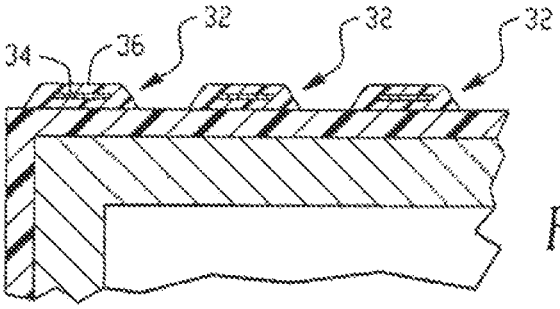
FIG. 4 shows an enlarged partial view of the corner of the cross-section of FIG. 2A.
Figure 6A:
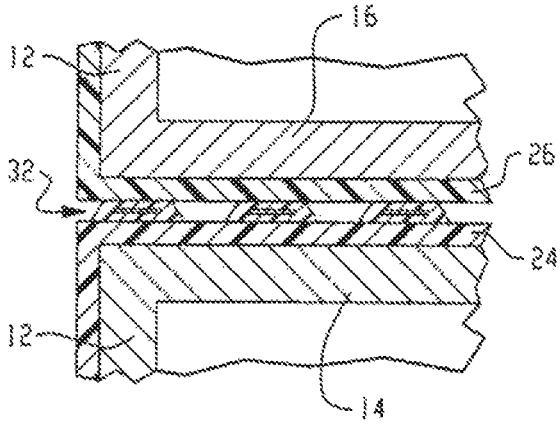
FIGS. 6A and 6B show partial cross-sections of one embodiment of fusion joints at adjacent liner plate flanges.
Figure 6B:
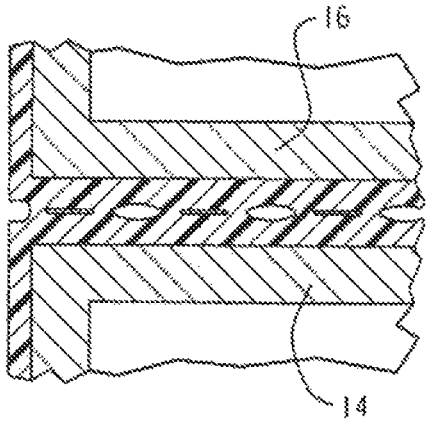
Figure 7A:
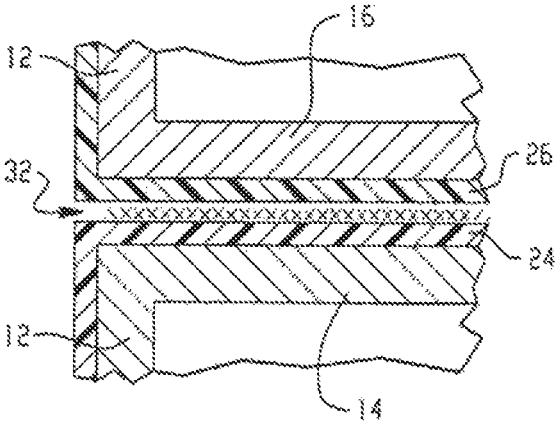
FIGS. 7A and 7B show partial cross-sections of another embodiment of fusion joints at adjacent liner plate flanges.
Figure 7B:
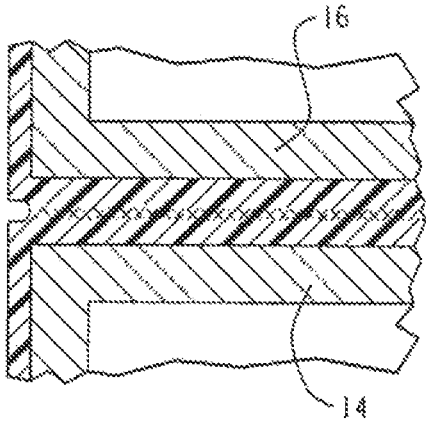

In this regard, and referring to FIG. 4, the flange portions of the liner plate may include one or more thermoplastic fusion elements (e.g., such as electro-fusion joining elements) extending therealong. The illustrated electro-fusion joining elements 32 include a generally planar resistive element 34 coated in polypropylene and the elements are applied directly to the outer surface of the polypropylene layer (e.g., per FIG. 5A). However, the shape of the elements 32 could vary, such as the oval or round-shaped elements shown in FIGS. 5B and 5C. For example, electrofusion chord as described in U.S. Pat. No. 5,407,514 could be used. Energisation of the resistive elements of the chord heats the thermoplastic and causes the fusion to take place. Preferably, the electro-fusion elements are incorporated into the liner plates prior to installation of the liner plates in the field, but in field of application of the electro-fusion elements may be possible. In this embodiment, when two liner plates are abutted against each other as shown in FIG. 6A, the electro-fusion elements 32 are sandwiched between the polypropylene layers 24 and 26 of the two liner plates. By passing current through the resistive elements 34 the two layers 24 and 26 are effectively joined or bonded together by electro-fusion welding of the material of the layers 24 and 26 and the material of the elements 32, per FIG. 6B. Thus, multiple sealing lines may be formed along the radial thickness or depth of the flanges, corresponding to the number of spaced apart sealing elements disposed depthwise along the flanges. In another embodiment, according to FIG. 7A, the electro-fusion element may be formed of a lattice-type resistive element that extends along substantially the entire flange depth, to produce a relatively continuous bond and seal along the depth of adjoining flanges per FIG. 7B. Other variations are possible. Although not shown, similar electro-fusion bonds would be formed between abutting left and right side flanges of side-by-side liner plates.

Figure 8A:
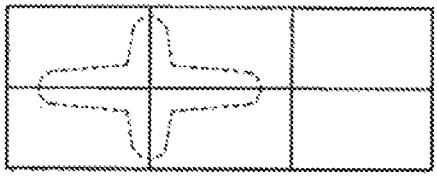
FIGS. 8A and 8B show exemplary liner plate assembly configurations.
Figure 8B:
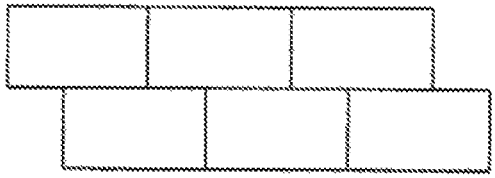

A plurality of like liner plates are assembled together to form, for example, a cylindrical mine shaft liner that is sealed against penetration by groundwater. Other mine shaft liner geometries arc possible as well, such as oval, elliptical or rectangular of other polygonal shapes. In one example, the liner plates are assembled in aligned columns and rows per FIG. 8A, but a preferred assembly configuration offsets the liner plates from row to row as shown in FIG. 8B. In either case, by electro-fusion bonding the adjacent flange portions of the liner plates, a sealed cylindrical structure can be formed (i.e., sealed along its entire height for a full 360 degrees).

Figure 9:
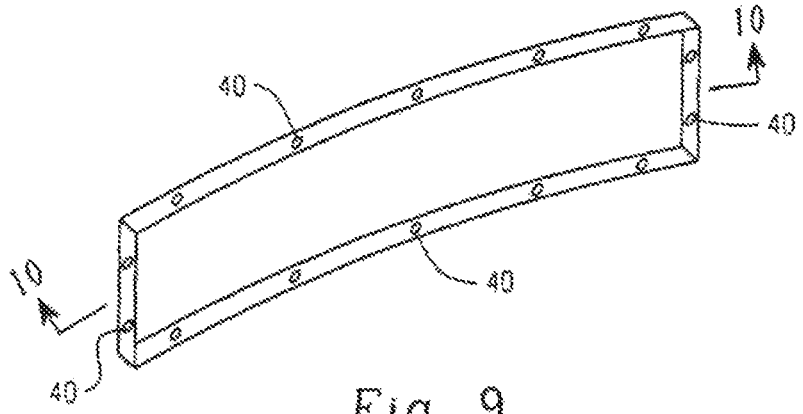
FIG. 9 show another embodiment of a liner plate structure including openings to facilitate assembly.

Various structures may be used to assemble adjacent liner plates together. In one example, per FIG. 9, openings 40 are provided in the flanges so that the openings of adjacent flanges align and nut and bolt assemblies can be used. At least one or more of the electro-fusion sealing elements, or portions thereof should, in such cases, extend along the external side of the opening (i.e., between the opening and the cylindrical outer surface of the arcuate plate 12).

Figure 10:
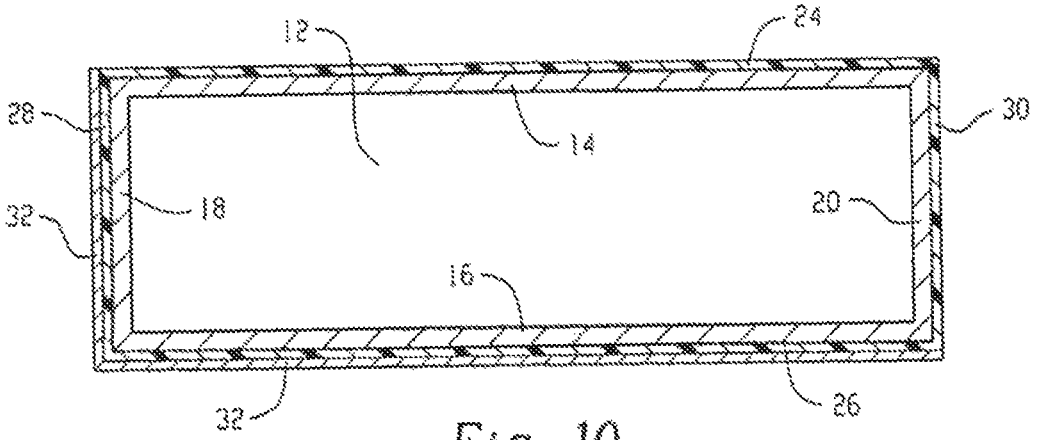
FIG. 10 shows a cross-section of the liner plate of FIG. 9 taken along line 10-10.

In order to provide desired sealing and suitable assembly, it is contemplated that in some embodiments a typical liner plate may include electro-fusion elements along only two flanges (e.g., one of the top and bottom flanges and one of the left or right flanges). For example, referring to the cross section of FIG. 10, one or more electro-fusion elements extend along the outer surfaces of polyethylene layers 28 and 26 of the left and bottom flanges, but not along the other surfaces of the polypropylene layers 24 and 30 of the top and right flanges. When properly assembled, a left flange with element 32 will always abut a right flange without element 32 so that the adjacent polypropylene layers can be sealed by electro-fusion, and a bottom flange with element 32 will always abut a top flange without element 32 so that the adjacent polypropylene layers can be sealed by electro-fusion. In such embodiments, it may be desirable to provide some structure on the liner plates that forces them to be assembled in the proper orientation (e.g., with the top flange always facing up and not inadvertently facing down).

Figure 11:
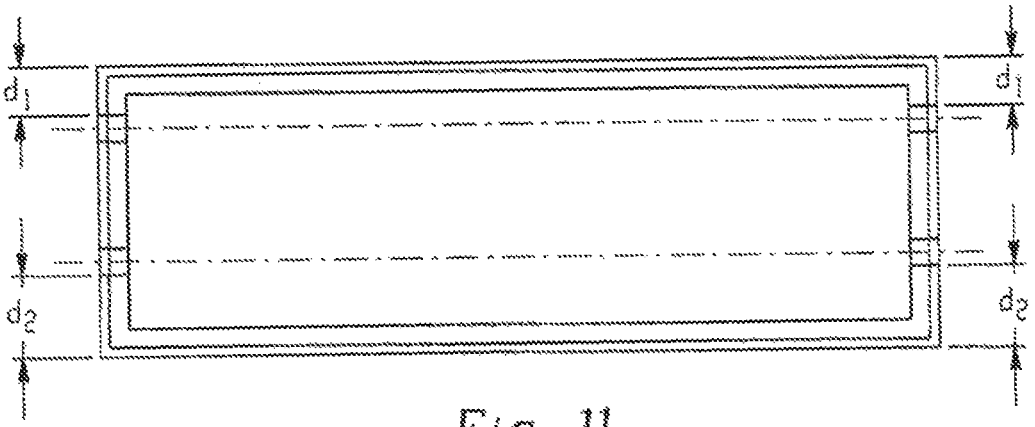
FIG. 11 shows another embodiment of a liner plate structure.
Figure 12:
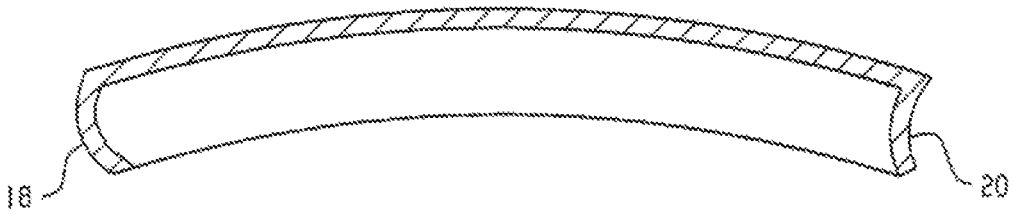
FIG. 12 shows another embodiment of a liner plate structure.

In one example, such a forced assembly arrangement could be achieved by non-symmetrical placement of the openings 40 on, for example the left and right flanges 18 and 20. Specifically, referring to FIG. 11, upper side flange openings 40*a* are spaced a distance d1 from the top edge of the liner plate and lower side flange openings 40*b* are spaced a distance d2 from the bottom edge of the liner plate, where d2 is greater than d1. As long as side-by-side liner plates are always arranged in the same top up orientation, the side flange openings will be centered on each other to facilitate receiving the nut and bolt assemblies. However, if one liner plate is arranged in a top up orientation and an adjacent side located liner plate is accidentally arranged in a top down orientation, the side flange openings will not align properly, preventing receiving of the nut and bolt assemblies, and thus alerting an installer to the improper orientation of one of the liner plates. Of course, other structures could be provided or used to force proper orientation of the liner plates during assembly. For example, per FIG. 12, the left flange 18 of each liner place could be bowed slightly outward about its vertical axis and the right flange 20 of each liner plate could be correspondingly bowed slightly inward along its vertical axis to achieve a mating relationship between left and right flanges when place side-by-side. Other variations are possible.

Figure 13:
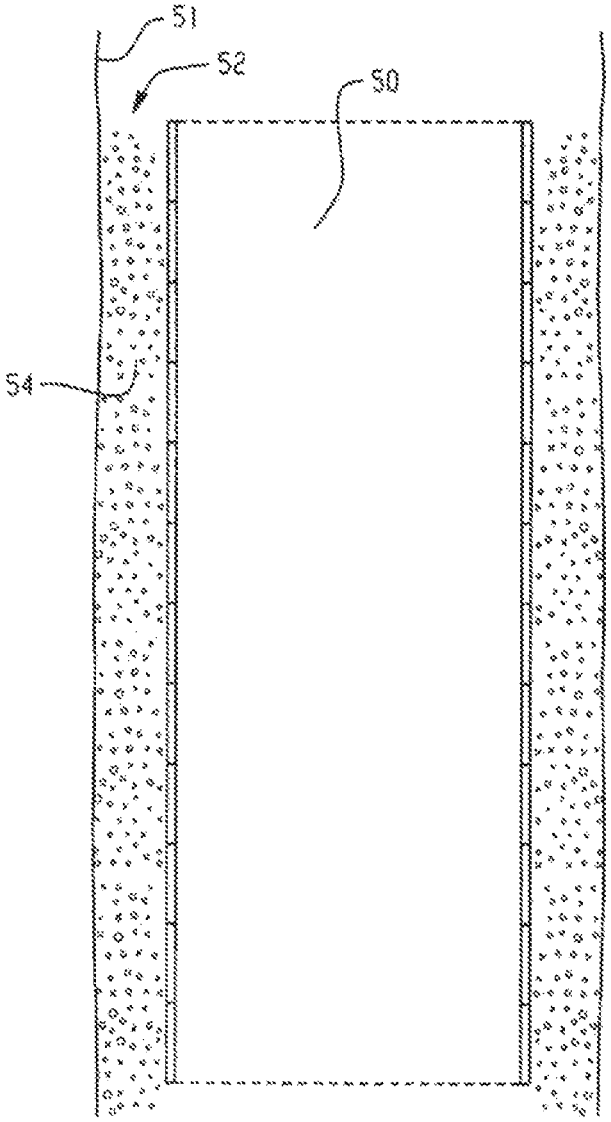
FIG. 13 shows an assembly of liner plates in a vertical mine shaft bore installation.

Referring to FIG. 13, an exemplary installation of assembled liner plates 12 to form a cylindrically extending liner 50 of a vertical mine shaft 51 is shown. Grout (e.g., cementious grout) or other filler material 54 may be delivered into the gap or spacing 52 between the external surface of the cylindrical liner and the inward facing surface or wall of the mine shaft bore 51 itself. In this regard, the arcuate plate portions of the liner plates may be formed with grout openings for purpose of feeding grout into the space, in which case suitable plug structures could be provided for such openings.

The ends of each electro-fusion chord should terminate so they are accessible from the inward facing side of the liner plate (e.g., radially inward of the arcuate plate), making them accessible from the inside of the assembled ring of liner plates when installed. The chord ends can protrude through the gap between mating plastic sheets or extended through openings or holes in the flange or flanges and terminate at the radially inner side of the flanges of the liner plate.

Preferably, the electro-fusion process is performed after full rings of liner plates have been assembled (e.g., each time one ring is assembled or each time a specified number of rings are assembled), but could alternatively be performed as individual liner plates are assembled into place.

In an alternative embodiment, electro-fusion chords may be eliminated and adjacent flanges of the assembled/installed liner plates could be field welded in place using, for example, a down-hole field extrusion gun that applies a thermoplastic material. In other embodiments, the a true metallic weld may be applied to adjacent flanges (e.g., at the radially inner edges of the abutting flanges).

Figure 16:
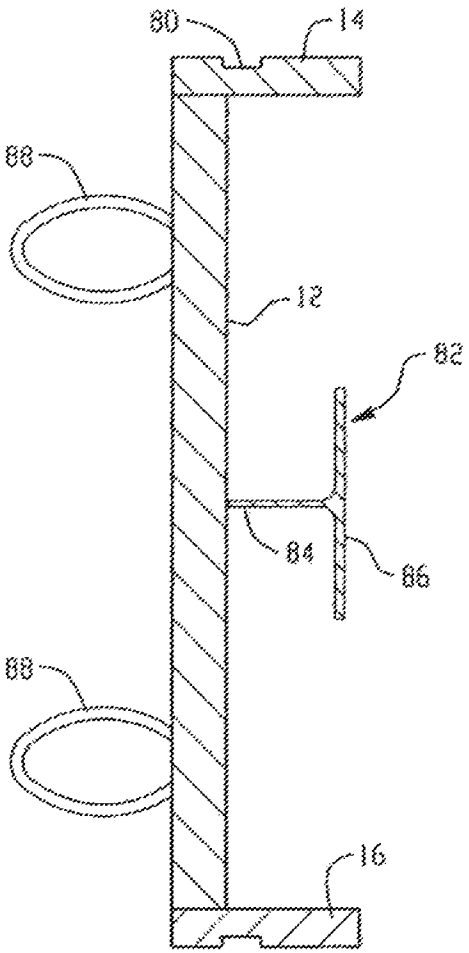
FIG. 16 shows the liner plate of FIG. 16 with anchor structure added.
Figure 15:
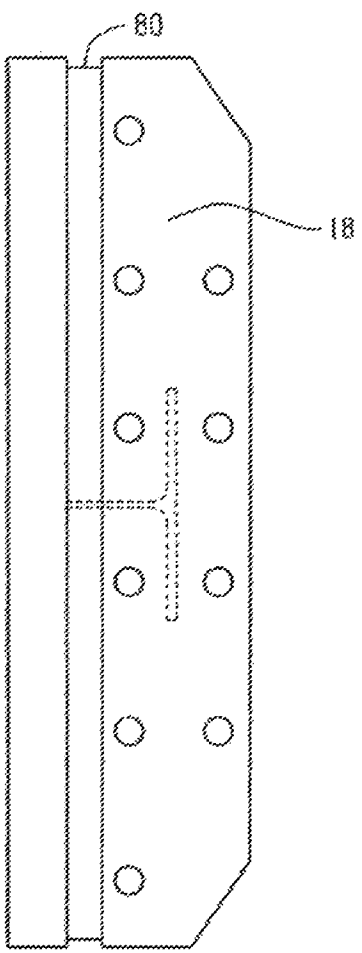
FIG. 15 shows a side elevation view of the liner plate of FIG. 14.
Figure 14:
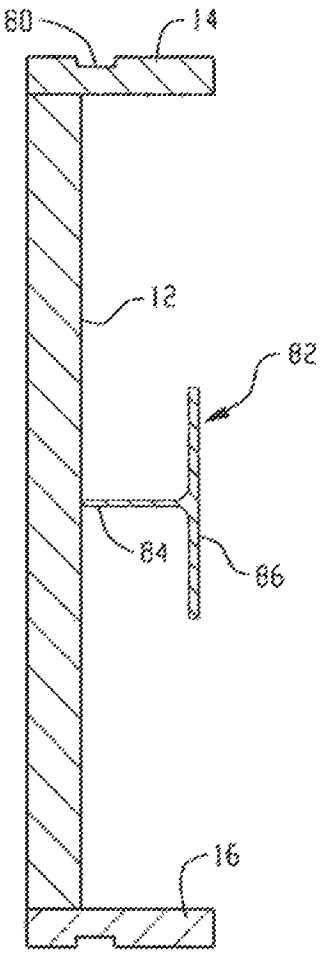
FIG. 14 shows another embodiment of a liner plate structure in partial cross-section view.

Referring to the embodiment of FIGS. 14-16, the electro-fusion chords may also be placed within a perimeter recess 80 formed in the flanges 14, 16, 18 and 20. Such a construction facilitates steel to steel contact between adjacent liner plates for better structural support by the installed liner system. In this regard, as will be described in more detail below, the electro-fusion chord installed in the recess may protrude slightly outward of the flange surfaces so as to assure contact with the chord of an adjacent liner plate. In one embodiment, the electro-fusion chord may include a compressible rubberized thermoplastic or rubber core and a thermoplastic exterior, making the chord more readily compressible when adjacent plates are bolted together.

Figure 17A:
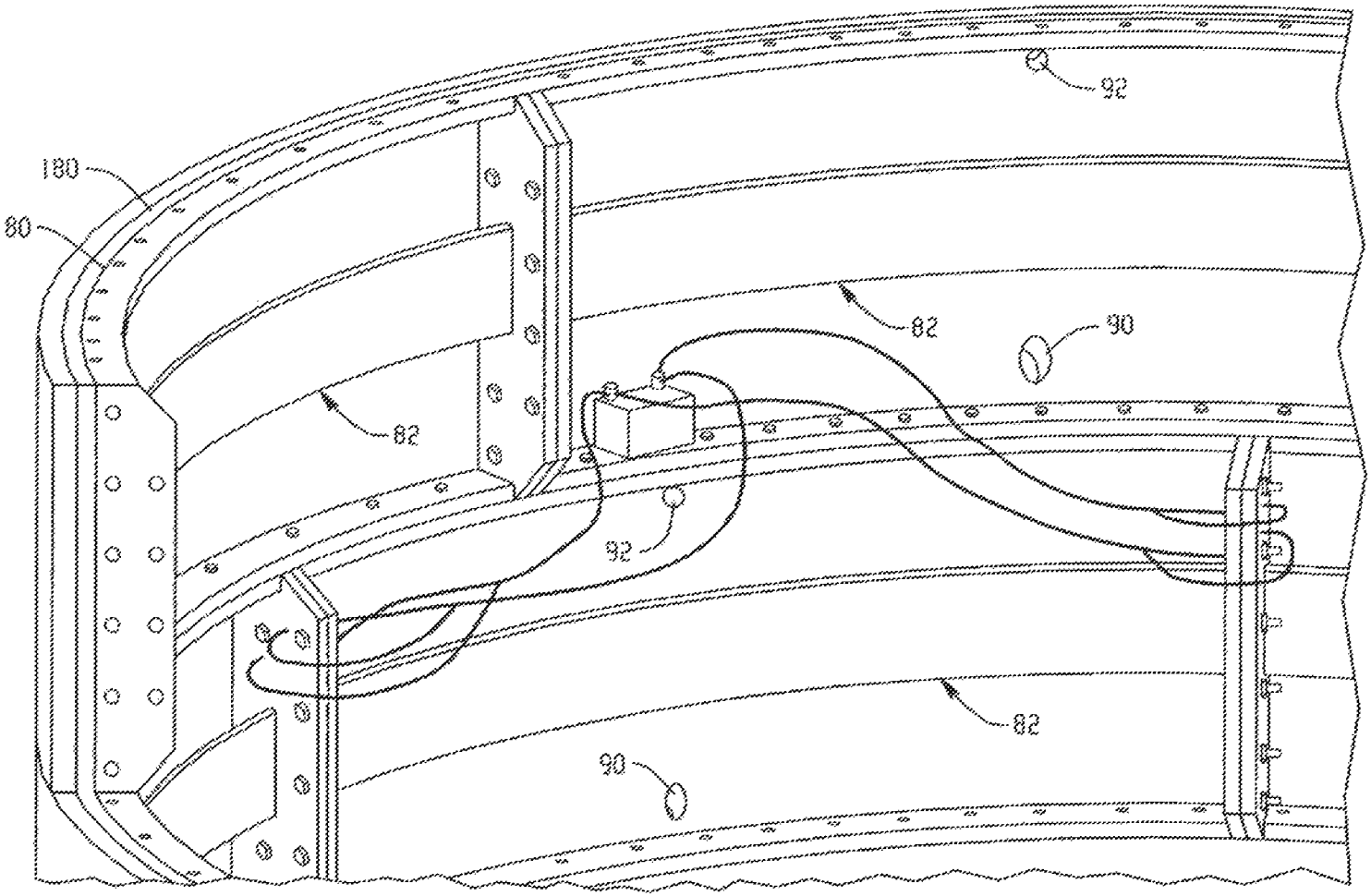
FIGS. 17A and 17B show assembled liner plate structures during electrofusion welding.
Figure 17B:
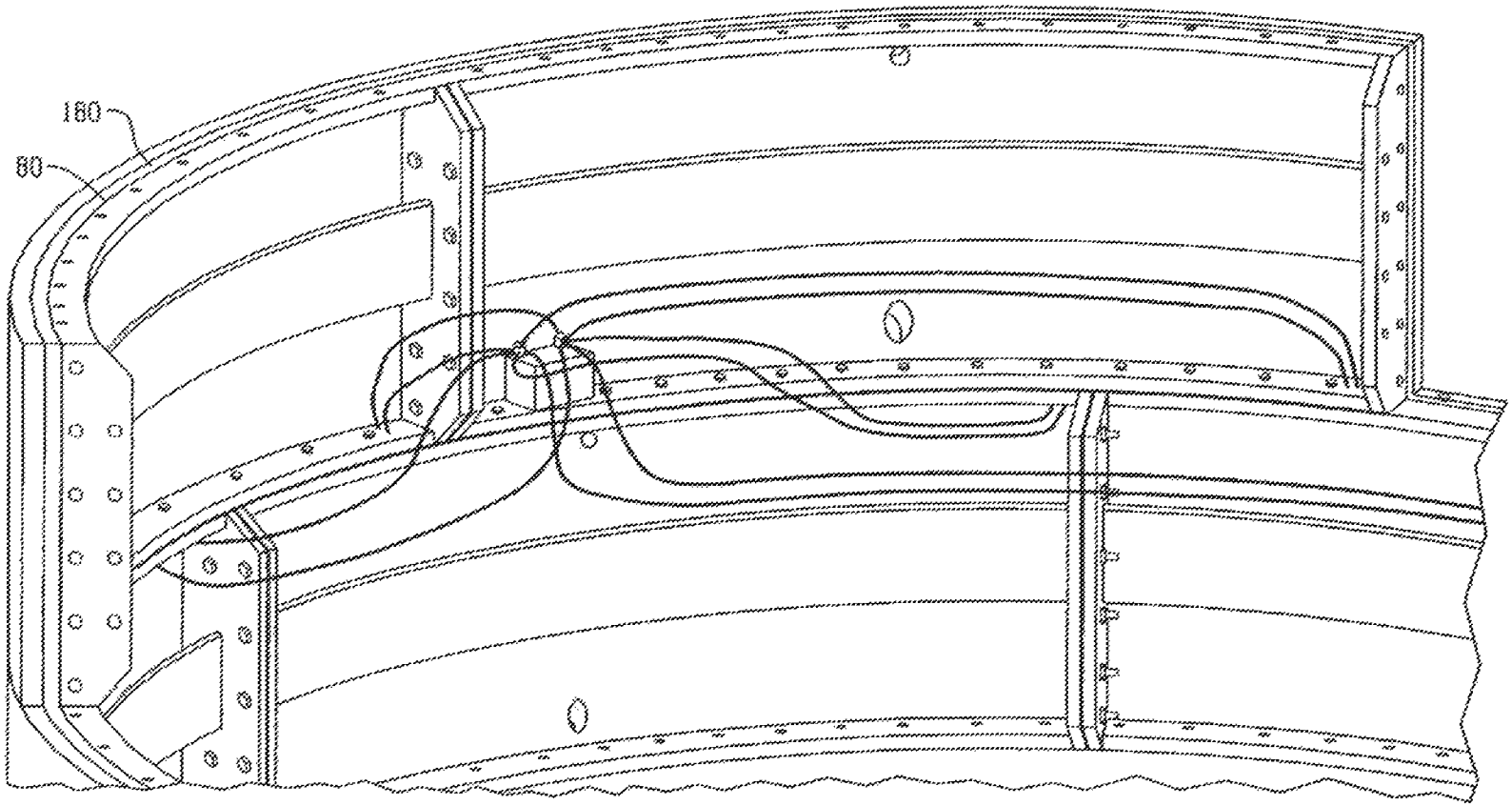

The liner plates may also include a structural member 82 on the primary plate portion 12. In the illustrated embodiment, the structural member is a T-shaped member, with the base 84 of the T-shaped member welded to the inner face of the arcuate plate portion 12 and the cross or head 86 of the T disposed radially inward of the arcuate plate portion. The T-shaped structural member has a curved configuration that matches the curve of the liner plate as best seen in FIGS. 17A and 17B. The configuration of the structural member could vary. By way of example, other possibilities include wide flange beams, tubes, channels, standing ribs, etc. Referring again to FIG. 16, anchor loops 88 may be connected to the external face of the arcuate plate portions 12 (e.g., by welding) to provided an integrated connection with the grout or other filler material that is delivered into any gap or spacing between the external surface of the cylindrical lifter and the inward facing surface of the mine shaft bore itself. The anchor loops may, by way of example be formed of curved rebar structure, such as #5 rebar. In this regard, the primary plate portion 12 includes one or more holes 90 and 92 (FIG. 17A) for delivering the grout into the space at the external surface of the liner. The holes 90 and 92 may be threaded to enable easy installation of a threaded plug to assure sealing of the holes (gaskets or thread dope may be used in connection with the plugs).

Figure 21:
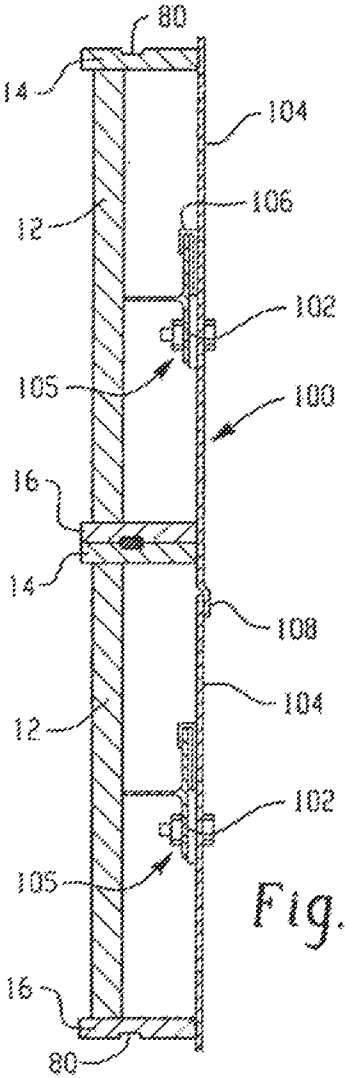
FIG. 21 shows multiple liner plates according to FIG. 19 with an interior liner assembly added.
Figure 20:
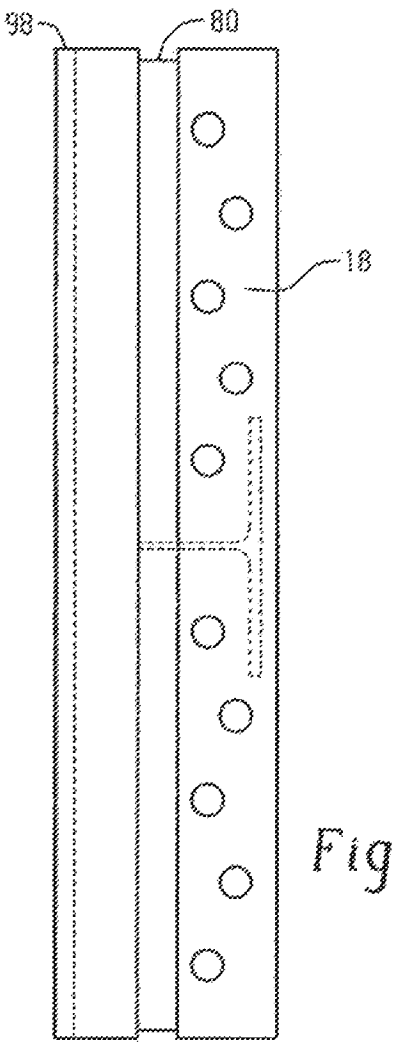
FIG. 20 shows a side elevation view of the liner plate of FIG. 19.
Figure 19:
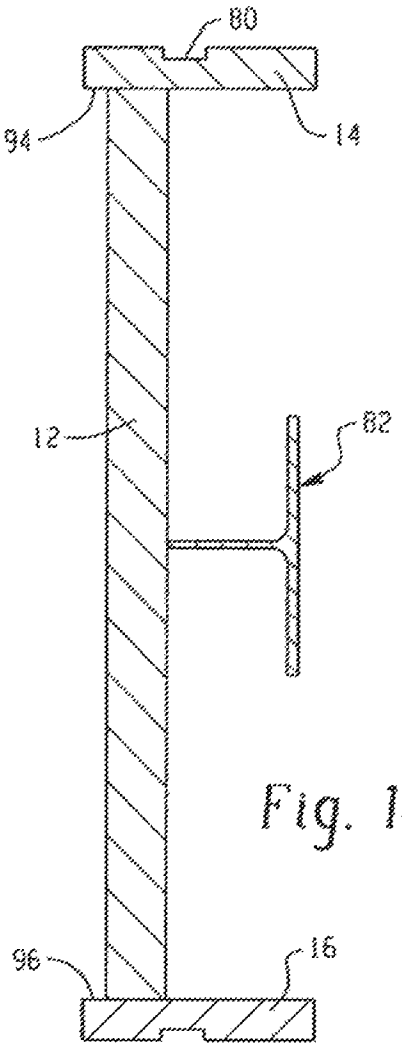
FIG. 19 shows another embodiment of a liner plate structure in partial cross-section view.
Figure 22:
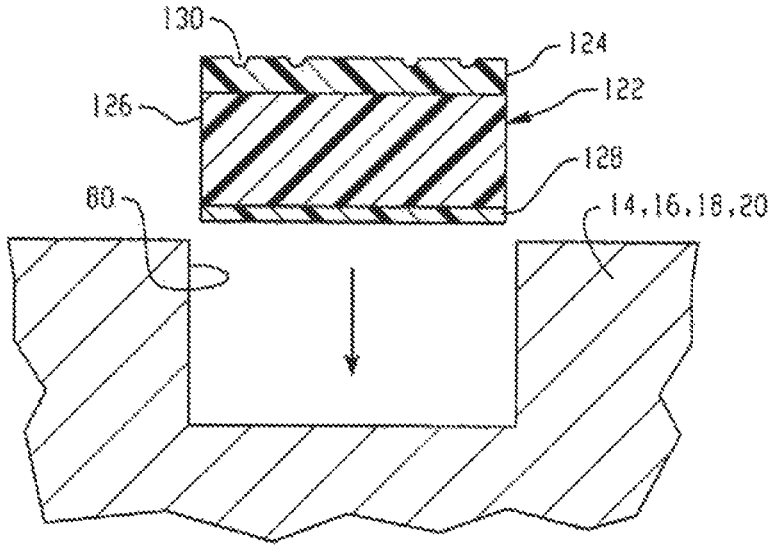
FIGS. 22-24 show a partial cross-section of a flange recess and electrofusion chord and extrusion assembly.

In another embodiment as shown in FIGS. 19-21, the flanges 14, 16, 18 and 20 may be connected (e.g., welded) to the main plate structure 12 so as to extend radially outward beyond the outer side face of the plate portion 12 slightly (e.g., ⅛inch to 1 inch or more) as shown at locations 94, 96 and 98. These overhanging portions act to assist in anchoring the plates to the fill grout to provide an integrated connection with the grout or other filler material, in which case the anchor loops may be eliminated in certain implementations. In addition, the overhanging arrangement facilitates use of a filet weld to secure the flanges 14, 16, 18 and 20 to the main plate portion 12.

Figure 18:
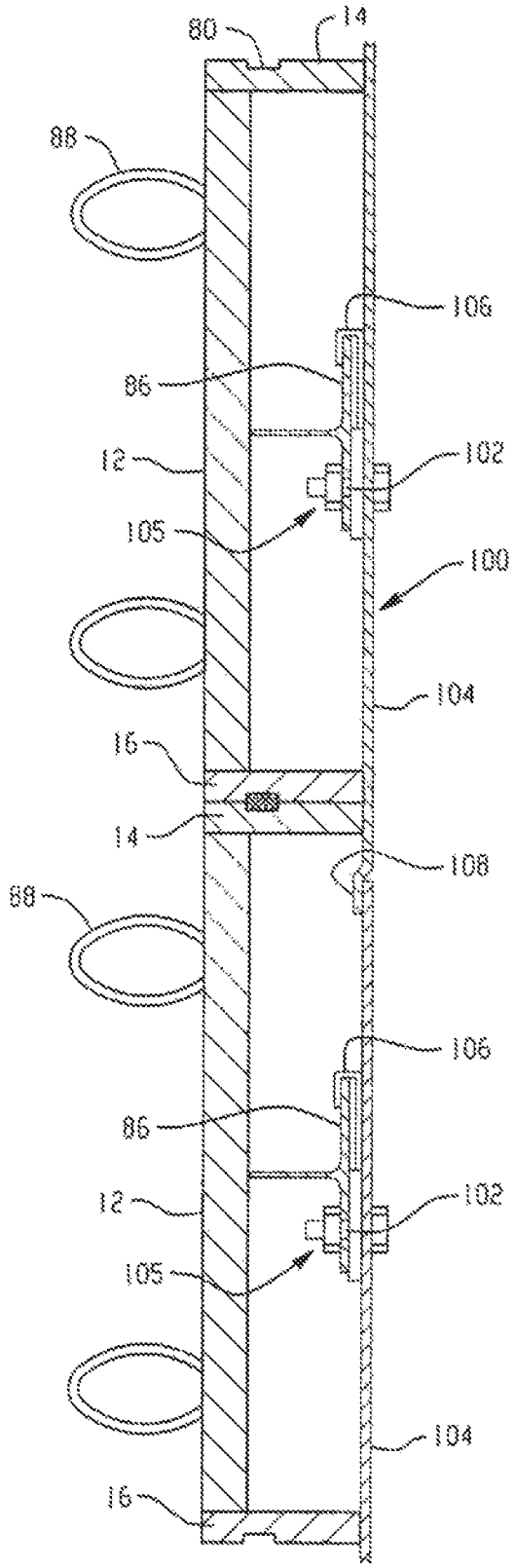
FIG. 18 shows a partial cross-section of assembled liner plates according to FIG. 16 with an interior liner assembly added.

As seen in FIGS. 18 and 21, in some embodiments, an inner liner system 100 may be connected to the plate structures upon installation and after thermoplastic fusion weld sealing. By way of example, the aforementioned T-shaped structural member may include a series of bolt openings 102 for connecting a smooth inner liner plate 104 formed of metal, plastic or other suitable material. Bolt and nut assemblies 105 secure the liner to the structural member. The inner liner members may also have an inward and downward facing hook structure 106 that overlaps and rests atop the upper edge of the T portion 86 of the structural member 82. Moreover, each inner liner structure may be formed with an inwardly (FIG. 18) or outwardly (FIG. 21) offset lower edge or flange 108 that receives the upper edge of an immediately adjacent lower liner structure. Alternatively, the upper edge could include the inwardly or outwardly offset flange to receive the lower edge of an immediately adjacent upper liner structure.

Where the liner plates are made for structural support of the shaft or tunnel wall, the thickness of the steel plate making up the arcuate plate and flanges may, for example, be on the order of two to four inches, but other variations are possible. In one embodiment the thickness of the arcuate plate portion is between 25% and 75% thicker than the thickness of the flanges (e.g., 50% thicker). The arcuate length or extent of a typical structural liner plate may be in the range of about 72" to 190", such as about 110" to 150", such as about 125" to 135", but variations in the range of 36" to 216" are envisioned as well. The arc encompassed by each plate may be in the range of about 40 to 80 degrees, such as about 50 to 70 degrees, such as about 60 degrees, but variations are possible, including in the range of about 40 to 180 degrees.

The radial depth of the flanges may be on the order of about 5" to 15" depending on the application, such as about 8" to 12" (e.g. about 10"), but variations in the range of 5" to 18" are envisioned as well. The width or radial depth of the recess to receive the electro fusion chord will typically vary according to the radial depth of the flanges. By way of example, the width or radial depth of the recess maybe on the order of about 10% to 30% of the radial depth of the liner plate flanges.

Figure 26:
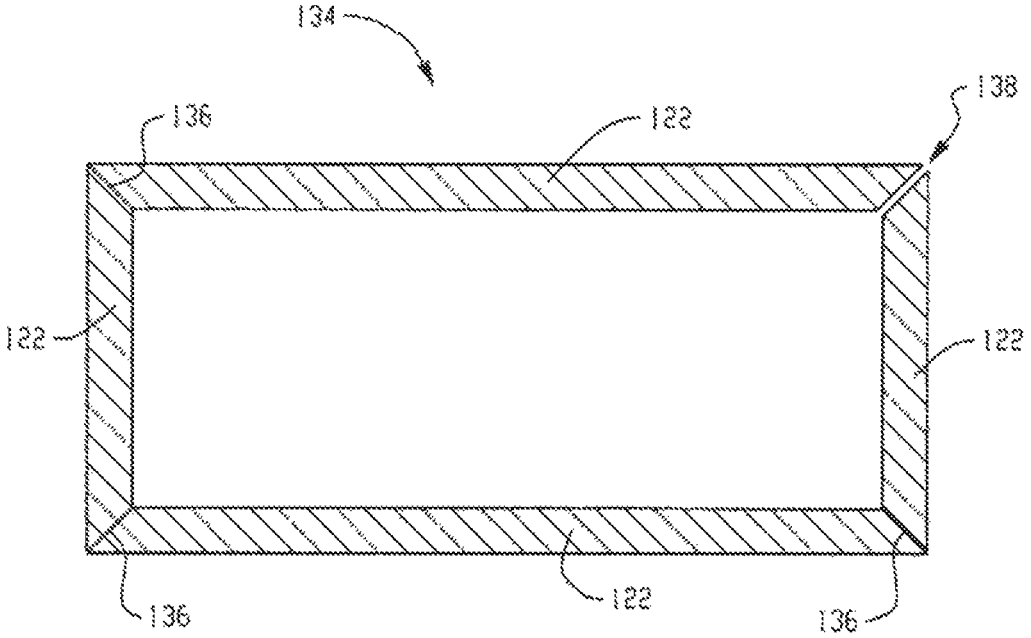
FIG. 26 shows a schematic cross-section of an extrusion ring structure.

Referring to FIGS. 22-25, where the chord is applied in a recess 80, the electrofusion chord 120 may be incorporated into an extrusion that is placed in the recess 80. In one example, a multi-layer gasket extrusion 122 of polypropylene top layer 124 (it is recognized that other materials may be used, particularly thermoplastic materials that are capable of heat fusion), an elastic polymer intermediate layer 126 (e.g., EPDM (ethylene propylene diene Monomer (M-class) material)) and a bottom layer of material 128 (e.g., such as sanoprene) that will bond to metal at the bottom of the recess in the presence of heat is created (e.g., via a co-extrusion process or via multiple layered extrusions). The polyproylene layer 124 may be formed with spaced apart recesses 130 (e.g., generally semicircular in form) that will receive the electrofusion chord 120 (e.g., chord that is circular in cross-section). The extrusion 122 is then cut to lengths to facilitate formation of a rectangular ring structure that can circumscribe the continuous, circumscribing recess 80 formed by aligned recesses of all flanges on a liner plate. As show in FIG. 25, end portions of extrusion strips 122 may be cut with a fourty-five degree taper and then bonded together (e.g., via heating) to form the right angle turns needed to transition from one flange to the next. A rectangular ring structure 134 with three fused corners 136 and one unfused corner 138 is formed (e.g., per the schematic cross-section of FIG. 26), enabling the ring structure to be applied into the recess 80 of a liner plate. Once applied, the corner 138 can be fused to hold the ring structure in place. Heat may then be applied at the inner surfaces of the flanges in the vicinity of the recesses to cause layer 128 to bond to the metal. In an alternative embodiment an adhesive (e.g., one that does not require heat) could be used to bond the ring structure in the recess 80.

In one implementation, all extrusions 122 making up the ring structure are straight and the upper and lower extrusions are flexible enough to take the shape of the curved recess portions of the top and bottom flanges 14 and 16 of the liner plate. In another implementation, the top and bottom extrusions may be cold rolled into the desired curvature prior to forming the ring structure 134. Of course, other techniques for placing the extrusion in the liner plate recess may be used, such as extrusion directly into the recess.

Figure 27:
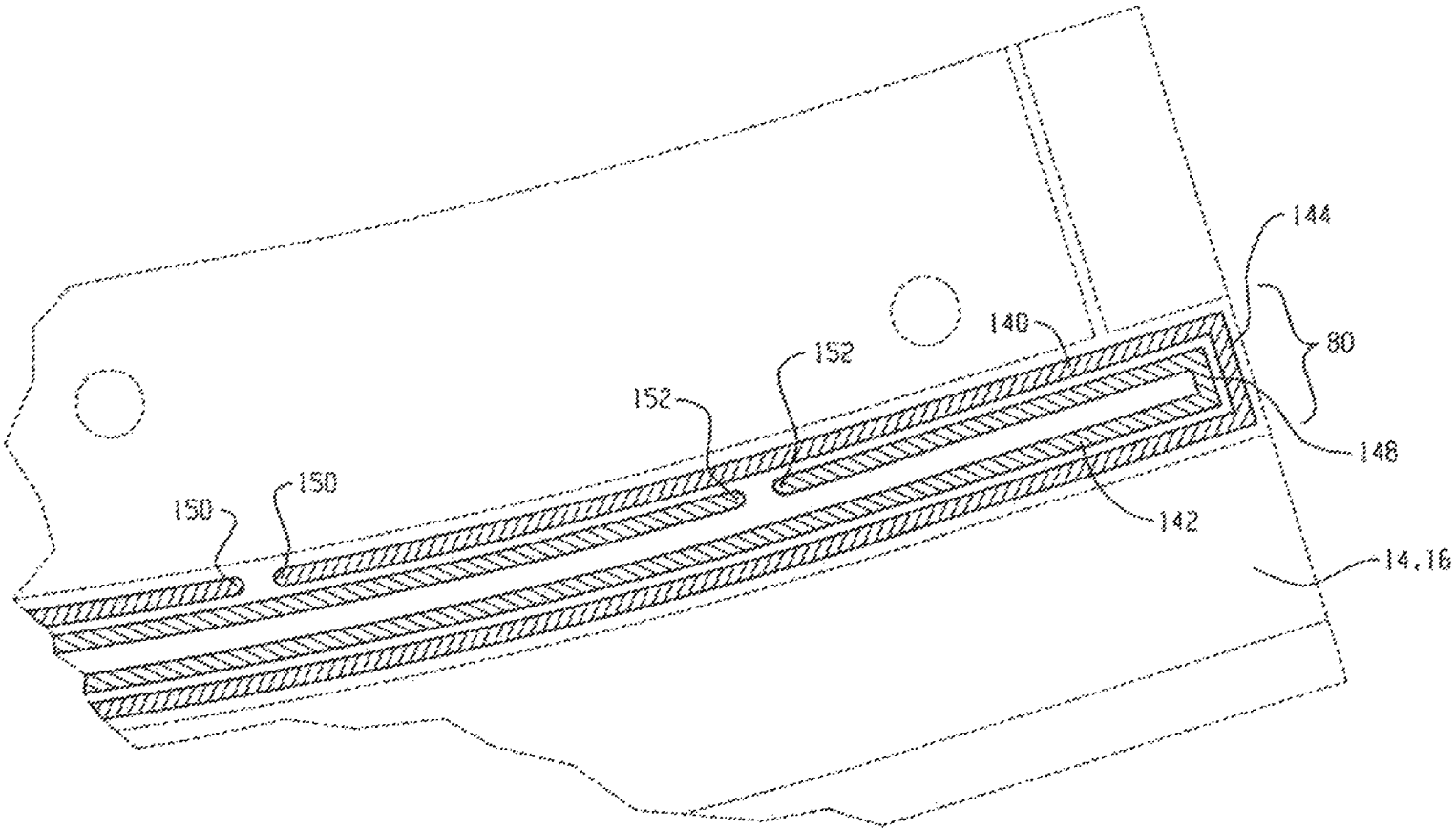
FIG. 27 shows a schematic layout of one arrangement of electrofusion chord.
Figure 28:
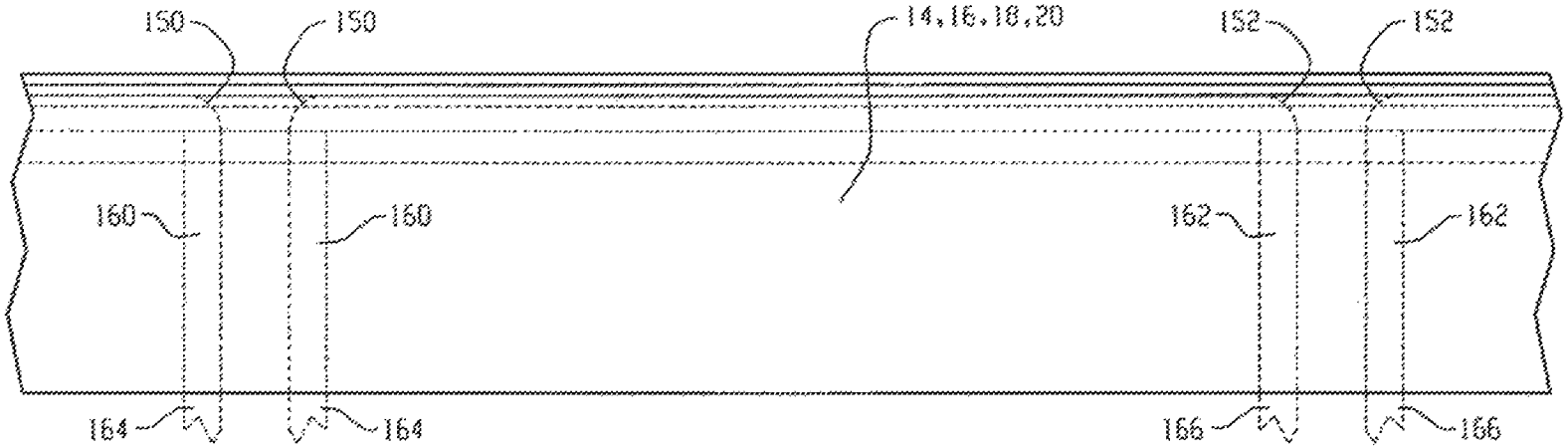
FIG. 28 shows a schematic partial cross section of the electrofusion chord arrangement of FIG. 27.

Once the base extrusion 122 is placed in the recess, the fusion chord 120 is then applied into extrusion recesses 130. In this regard, numerous configurations for the placement pattern of the chord are possible. In one embodiment, as best seen in FIG. 27, the recess 80 of each flange is fitted with two distinct fusion chord loops as outer and inner loops 140 and 142. Transverse recesses are cut into the extrusion ends to receive the lateral portions 144 and 148 of the chords. These lateral portions 144 and 148 may be curved portions rather than straight portions. Each fusion chord loop 140, 142 is terminated with loop ends 150 in proximity to each other and loop ends 152 in proximity to each other. The loop ends 150 are displaced relative to loop ends 152 by some distance. As best seen in the schematic view of FIG. 28, at the location of the loop ends 150 and 152 holes 160 and 162 are drilled through the flange and the fusion chord fed through the holes so that each fusion chord loop has end portions 164, 166 that are accessible at the internal side of the liner plate to facilitate connection of the power supply for the fusing operation.

Figure 23:
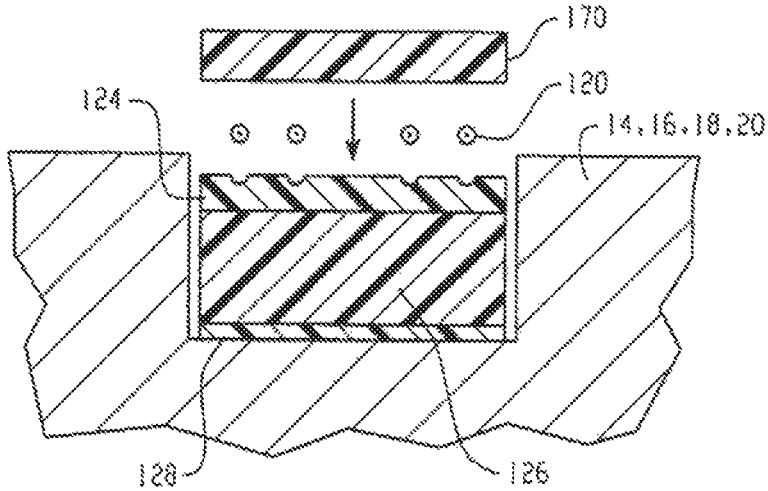
Figure 24:
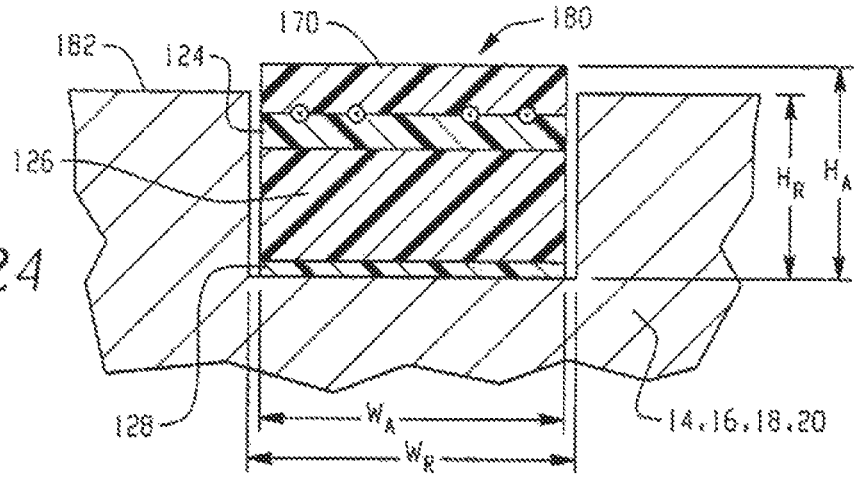
Figure 25:
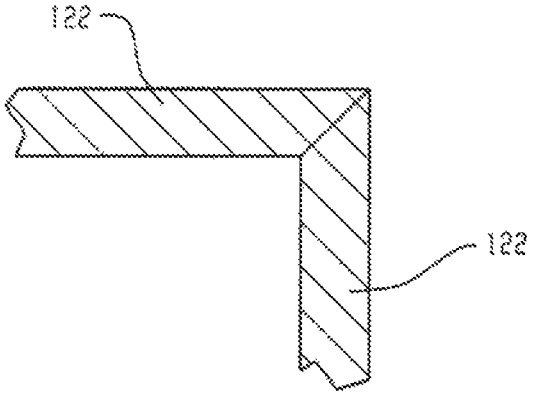
FIG. 25 shows a partial cross-section of a corner section of an extrusion.

Referring to FIGS. 23 and 24, once the chord is applied to the recesses 130 of the extrusion ring, an overlayer 170 of polypropylene is applied (e.g., via extrusion) over the top to hold the chord in place. In one embodiment, as shown in FIG. 24, the end result is a thermoplastic fusion element in the form of a multi-layer fusion assembly 180 applied in the recess 180 with upper layer 170 extending slightly above the exterior surface or side face of the flange 182, and with one or both of the side edges of the assembly spaced from the side edges of the recess. The raised nature of layer 170 assures good contact with a similar raised layer of an adjacent liner plate flange when two plates are secured together with flanges surfaces 182 contacting each other. The side to side spacing provides sufficient room for the assembly 180 when it is compressed (e.g., downward compression of the multi-layer assembly results in some outward bowing of the sides of the assembly 180). In one example, the height $H_A$ of the assembly 180 before compression is between about 10% and 20% greater than the overall recess height $H_R$ (e.g., for a recess having a depth of about ¼" to ¾" the assembly may protrude by about 0.025" to 0.15"), but variations are possible. Likewise, the width (or radial depth) $W_A$ of the assembly 180 before compression may be between about 2% and 8% less than the width (or radial depth) $W_R$ of the recess (e.g., for a recess having a width or radial depth of about 1.75" to 2.25" the width or radial depth of the assembly may be between about 1.60"and 2.20"), but variations are possible.

In one process, the height of the fusion assembly 180 above the surface 182 of the flange may be defined by implementing a post installation trimming operation. That is, the assembly 180 may be fully formed in the recess 80 such that layer 170 extends higher than desired. A planing type device may then be run along the surface 182 to trim the layer down to the desired height. However, other techniques could also be used.

During a fusion process, as the resistive elements in the fusion chords 120 of adjacent fusion assemblies 180 are energized and heating takes place, the polyproylene layers 170 and 174 are heated and fusion of abutting layers 170 takes place. In some embodiments, the heating may also cause the exterior sides of the layers 170 and 174 to bond to the side walls of the recess 80.

Figure 30:
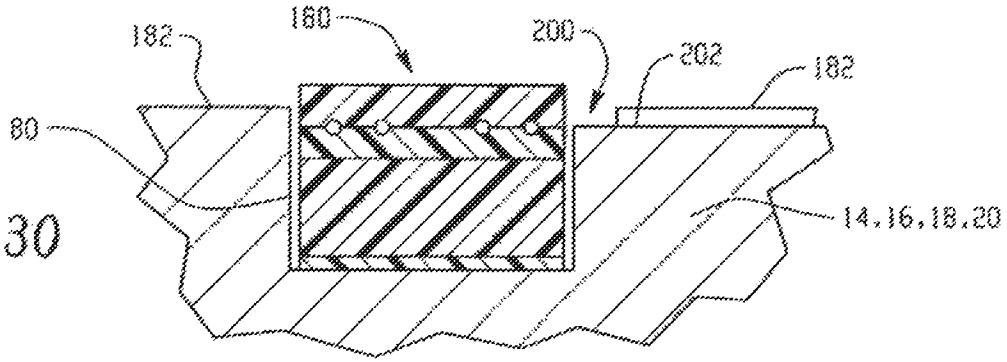
FIG. 30 shows a partial cross-section of the liner plate of FIG. 29.
Figure 29:
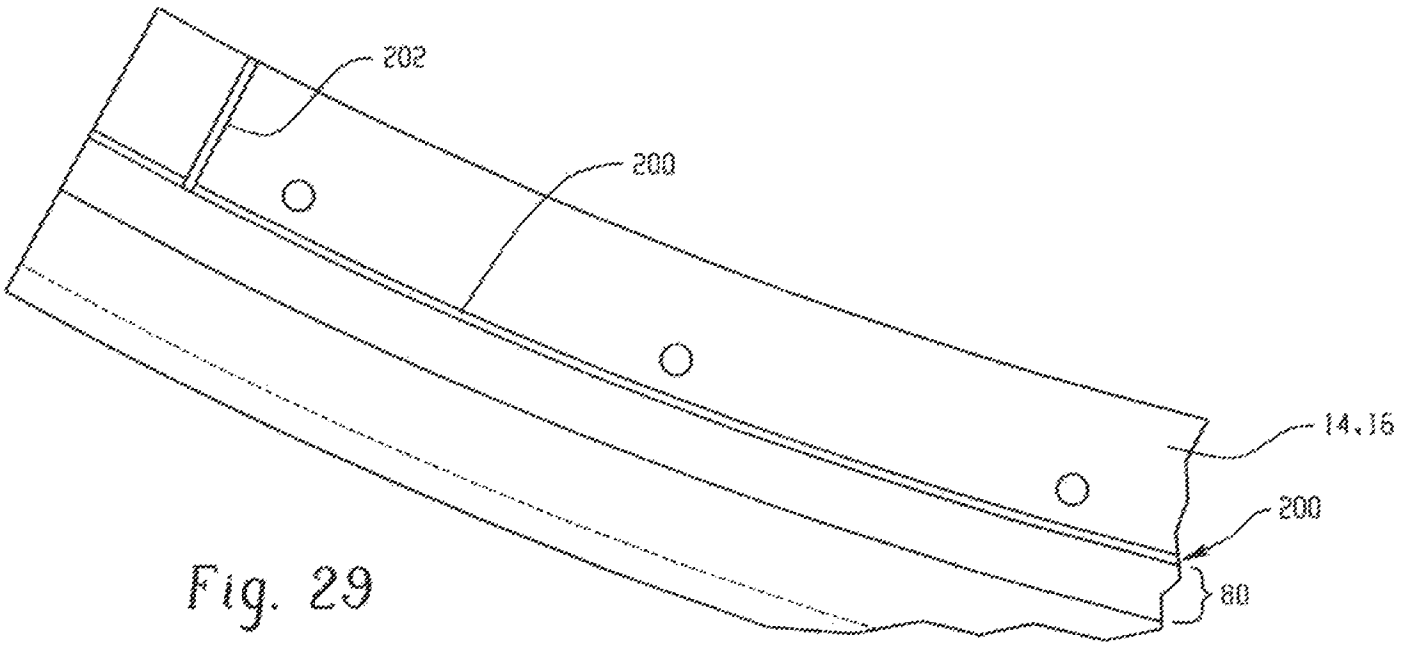
FIG. 29 shows another embodiment of a liner plate structure including a secondary sealing recess.

Referring now to FIGS. 29 and 30, a secondary or back-up sealing system may also be enabled by providing a small recess,or sub-recess 200 in the flanges at the radially internal side of the recess 80 and extrusion assembly 180 (e.g., in the illustrated embodiment immediately adjacent to the recess with one side of the sub-recess in communication with the. recess 80). This sub-recess 200 (e.g., about 1/16 to 3/16inch depth and ⅛" to ½" wide (or radial depth), such as, about ⅛" deep and ¼" wide) on the flanges would align with a similar recess on adjacent flanges of adjacent liner plates to create a continuous recess (e.g., ¼" by ¼" in total) that could be filled with grout or other sealant (e.g., via a radially inward extending portion 202 or portions of the sub-recess that extend to the inward facing side edges of the flange). By providing multiple radially inwardly extending sub-recess portions 202 on each flange that can be selectively and temporarily plugged, the location of a leak along a given plate structure or circumferential extension of plate structures can be identified. Specifically, the method of testing for a leak may involve plugging two spaced apart sub-recess extensions 202 (e.g., inserting a temporary plug the sealingly abuts against the thermoplastic fusion element) and then applying pressurized air to a sub-recess extension located between the two plugged extensions. If the sub-recess holds the pressure, then the thermoplastic fusion seal is deemed sound in the region between the two plugged sub-recess extensions. If the sub-recess does not hold the pressure, then the thermoplastic fusion seal is deemed imperfect or leaking in the region.

As a matter of practice, the secondary recess 200 may be filled with grout, only in situations where a leak is identified. Alternatively, the secondary recess 200 may always be filled with grout to provide the secondary or back-up seal for the installation.

Figure 31:
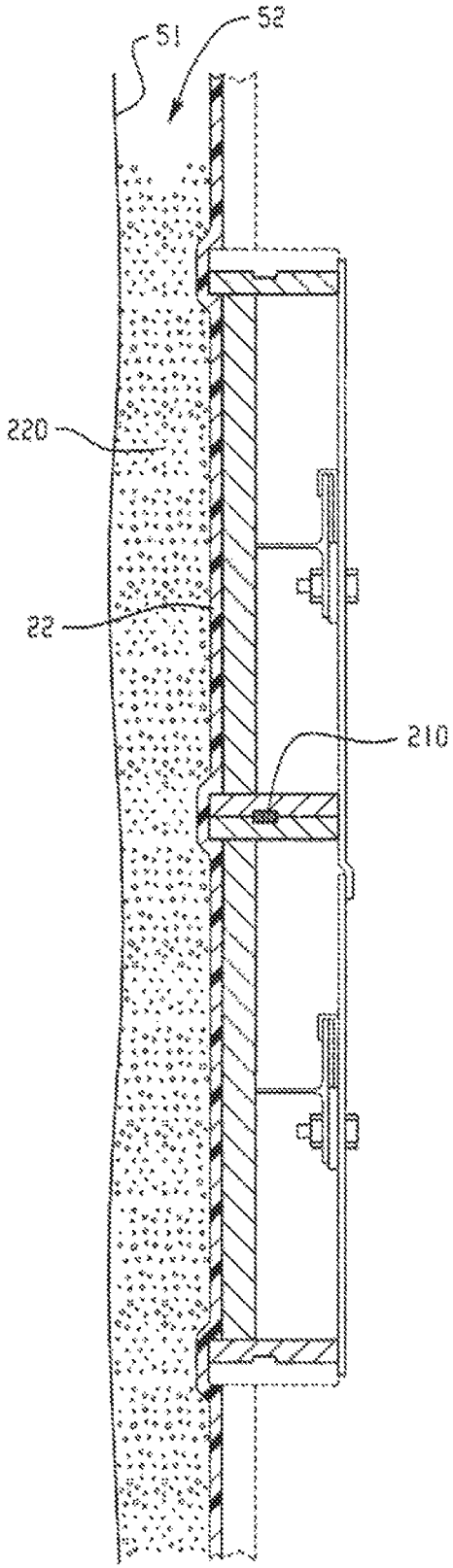
FIG. 31 shows a cross-section view of an arrangement of liner plates including an exterior polyurea coating.

Referring now to FIG. 31, an embodiment including a two or three stage sealing system is shown. Specifically, the electrofusion chord assembly seal 210 is provided between adjacent flanges of the liner plates. At the external surface of the assembled liner plate structure a polyurea coating 212 is also applied for sealing purposes. The polyurea coating may be applied by suitable spray process and may, by way of example, have a thickness of between about 1/10" and 1/2", but variations are possible. The third stage sealing could be by way of the grout seal mentioned above.

In terms of overall assembly process, in one method, the liner is assembled in a top down manner in the case of a vertical mine shaft installation. A series of liner plates are assembled together with nut and bolt assemblies within the shaft to form a ring. That ring is then raised upward and connected via nut an bolt assemblies to the lower side of a previously installed ring. The exterior of the joined rings is then sprayed with polyurea to provide the first sealant barrier. Suitable equipment capable of reaching the exterior side of the assembled liner plate rings may be used for this purpose. Additional ring layers may be added in a similar fashion (by repeating the foregoing steps) to achieve the desired depth of the liner plate structure. Periodically (e.g., after every ring or every few rings are assembled), grout may be applied to the exterior of the polyurea layer in the space 52 between the bore or shaft 51 and the liner assembly by providing a temporary form structure at the bottom of the lowest ring layer and pumping grout 220 upward into the space 52 between the liner plate assemblies and the mine shaft bore wall 50. The electrofusion sealing may also be performed periodically by delivering power to the leads of the electrofusion chords. In this regard, reference is made to FIGS. 17A and 17B, where FIG. 17A contemplates energization of the chords on the vertical plate flanges and FIG. 17B contemplates energization of the chord on the horizontal plate flanges. The exact number of chords energized at any one time and the overall sequence of energization could vary.

It is also recognized that in any given application a mine or tunnel shaft liner system could be made up of a combination of liner plate structures with thermoplastic fusion seals and liner plate structures without thermoplastic fusion seals. For example, certain sections of the liner system could utilize the thermoplastic fusion seals in those regions where groundwater is an issue and other sections could be installed without the thermoplastic fusion seals in regions where groundwater is not an issue.

Figure 32:
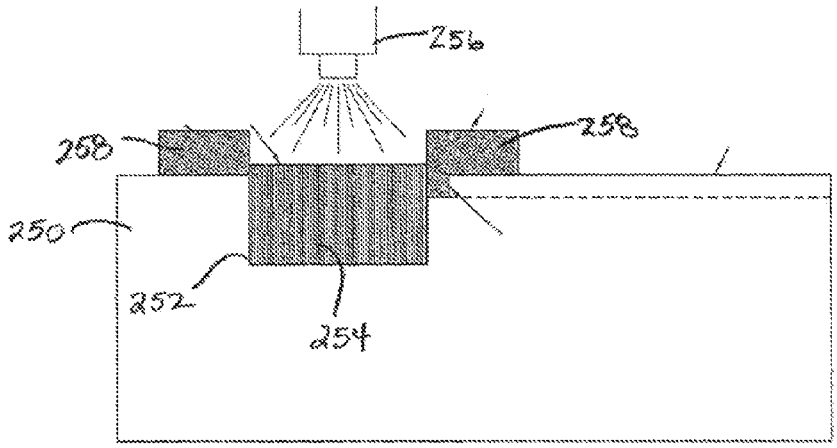
FIGS. 32-34 show cross-section views of another liner plate seal arrangement.
Figure 33:
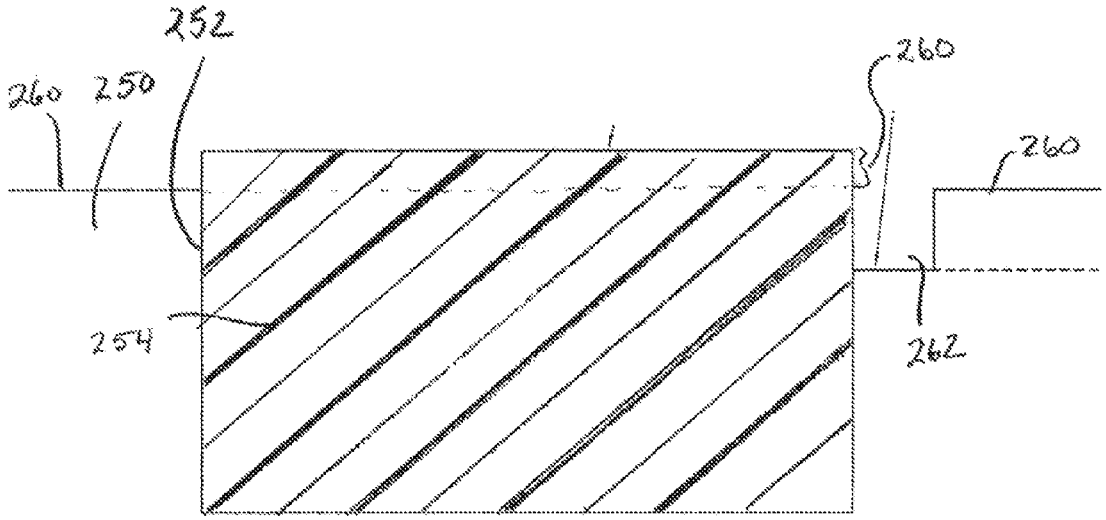
Figure 34:
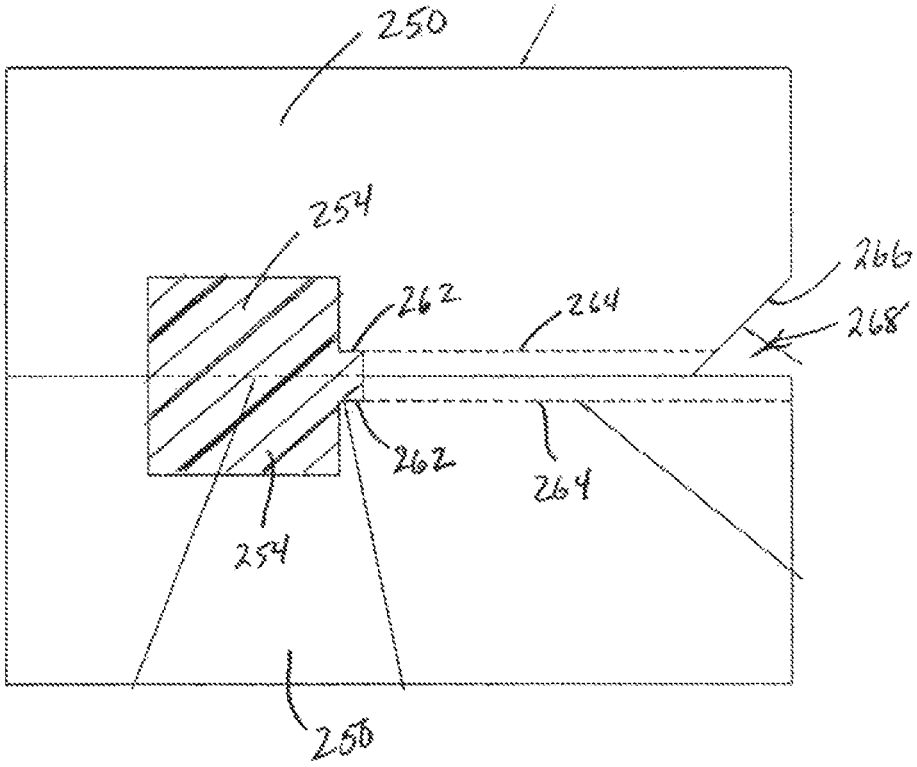

Referring now to FIGS. 32-34, another embodiment of a liner plate structure seal arrangement is shown. In this embodiment, each flange (represented here by flange 250) of the liner plate structure includes a recess 252 into which a polymeric seal 254 is applied via a plural component material processing technique. As used herein, the term plural component processing technique means blending two or more chemicals together in a specific or varying ratio with either direct impingement equipment, equipment utilizing a static mixer assembly to mix/bled the chemicals or by mixing in an open container by hand or by other mechanical mixing method to produce material that cures to some degree. In the illustrated embodiment, an impingement mix spray process is shown using a spray mechanism 256, with seal forms 258 placed alongside the recess 252 during the application process to define an upper portion 260 of the seal 254, which portion 260 protrudes above the recess 252. The seal forms 258 are removed after application of the seal member. Prior to applying the seal member, the recess 252 may be prepared by use of an abrasive blast process that forms a 3 mil minimum surface profile on the bottom and sides of the recess, which assures good bonding or adhesion of the seal member within the recess. Although a spray process or impingement mix process is shown, the seal member could alternatively be applied via a static mix injection process or by a cast in place process. In either case, the seal member can be applied in a manner that results in a continuous, seamless seal circumscribing the liner plate structure via the recesses in all four flanges of the liner plate structure.

As shown in FIG. 33, the seal member 254 is applied so as to protrude from the top of the recess. In this regard, it is contemplated that a planing type device may be run along the surface 260 to trim the seal member down to a specified, desired height. However, other techniques could also be used to achieve the final height of the seal member. As shown, a sub-recess 262 runs alongside the recess 252 at the radially inward facing side of the plate structure and forms both a repair channel into which grout or other sealant can be placed as previously described above in connection with the sub-recess 200. The sub-recess 262 also forms an expansion space into which the seal member 254 can move when liner plate structures are assembled together and the seal member is compressed.

In this regard, reference is made to FIG. 34 where two mated flanges 250 are shown with respective seal members 254 in mating contact and compressed so as to fill a substantially portion of the sub-recess 262. However, the sub-recess may be configured wide enough to also allow space for secondary or repair sealing via grout as previously described. For this purpose, radially extending sub-recess portions 264 may be provided (e.g., similar to portions 202 described above in connection with the embodiment of FIG. 30). Prior to joining two liner plate structures together, a chemical weld activator coating may be applied to the outwardly facing surface of each seal member 254 so that when the two seal members engage each other they become welded together, further enhancing the seal effect. By way of example, the polymeric seal material may be a plural component impingement mix polyurea product and the chemical weld activator may be a single component, brush applied material that will chemically bond thermoset polyurethane/polyurea material systems.

In one embodiment, a bonded monolithic polymer seal (BMPS) material may be used, made up of a plural component system consisting of an "isocyanate" (also known as a diisocyanate with other variations that may include: isophorone diisocyanate, methylene diphenyl diisocyanate, toluene diisocyanate or hexamethylene diisocyanate) and mixed with one or more of the following: an alcohol, an hydroxyl, a polyol, or an amine, creating a "polyurethane or polyurea" compound. An example of this material is Custom Linings 911 pure polyurea, available from Custom Linings, Inc. of Beuna Vista, Colo., but there are products that may be used.

In one embodiment, the chemical weld material may be a single or plural component system that consist of ingredients that will chemically bond thermoset polyurethane/polyurea material systems, primarily but not limited to dephenylmethane diisocyanate and methl-2-prrolidinone. An example of this material is Custom Linings SCP (although packaged as a single component, system could also be packaged as a multi-component system). Other products might alternatively be used.

Also shown in FIG. 34 is a further seal enabling structure of the liner plate system. Specifically, at least one of the upper and lower flanges and at least one of the right and left flanges of each liner plate structure may be formed with a recessed portion 266 (e.g., a chamfer) along its radially inward edge such that, when liner plate structures are joined together, a weld recess 268 is formed to facilitate application of a metallurgical weld between the plate structures if necessary or desired.

Figure 35:
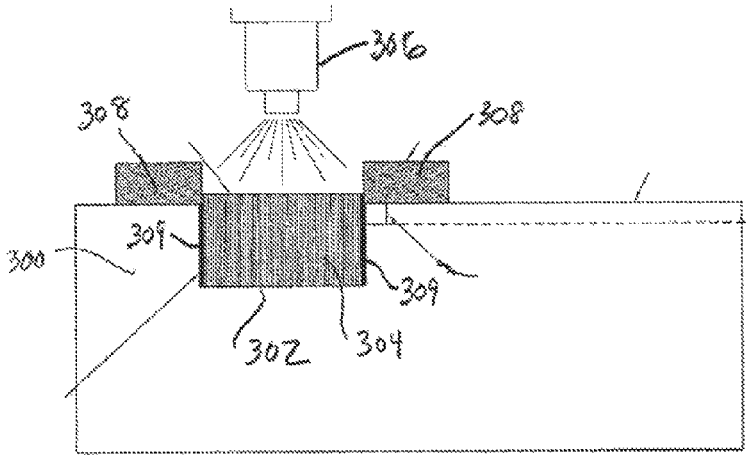
FIGS. 35-37 show cross-section views of another liner plate seal arrangement.
Figure 36:
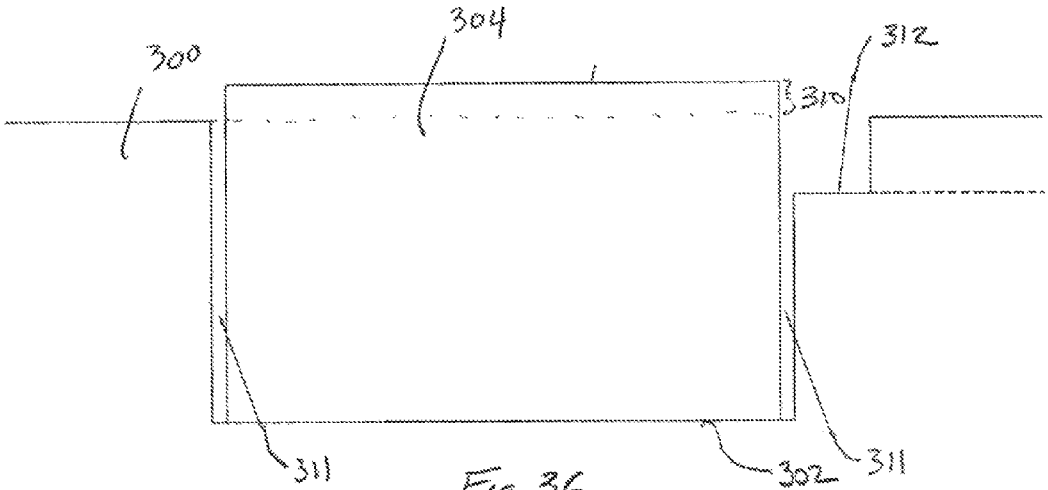
Figure 37:
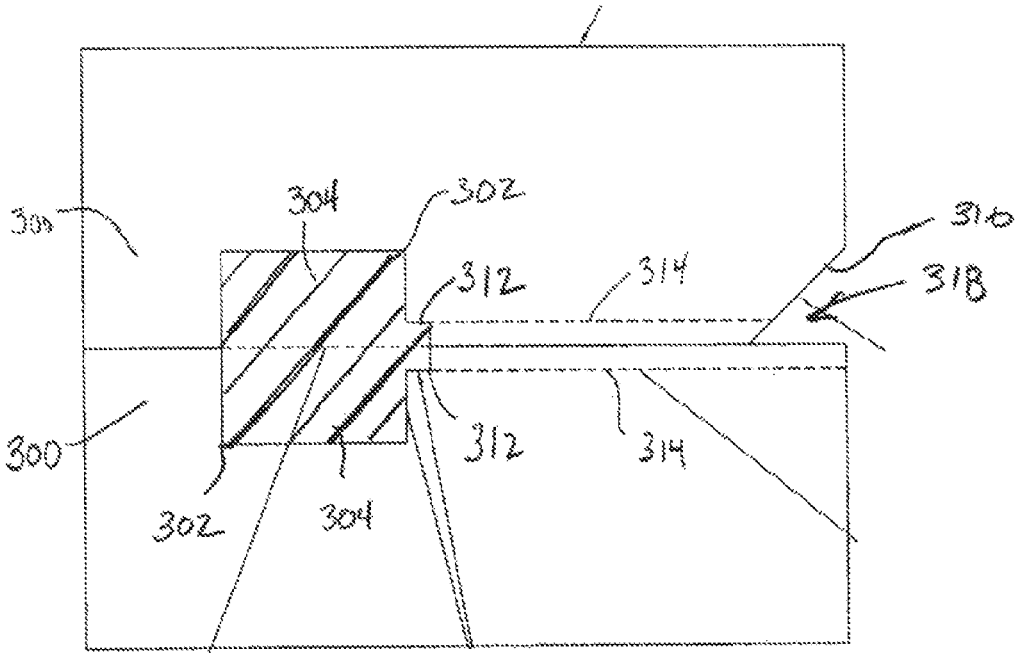

Referring now to FIGS. 35-37, another embodiment of a recess and seal arrangement for liner plate structures is shown. In this embodiment, each flange (represented here by flange 300) of the liner plate structure includes a recess 302 into which a polymeric seal 304 is applied via a plural component material processing technique. In the illustrated embodiment, an impingement mix spray process is shown using a spray mechanism 306, with seal forms 308 placed alongside the recess 302 during the application process to define an upper portion 310 of the seal 304, which portion 310 protrudes above the recess 302. Additionally, seal forms 309 are placed within the recess along the radially inner and outer sides of the recess during the application process. The seal forms 308 and 309 are removed after application of the seal member. As in the above case, prior to applying the seal member, the recess 302 may be prepared by use of an abrasive blast process that forms a 3 mil minimum surface profile on at least the bottom of the recess, which assures good bonding or adhesion of the seal member within the recess. While a spray process or impingement mix process is shown, alternatively the seal member could by applied via a static mix injection process. In either case, the seal member can be applied in a manner that results in a continuous, seamless seal circumscribing the liner plate structure via the recesses in all four flanges of the liner plate structure.

As shown in FIG. 35, the seal member 304 is applied as to protrude from the top of the recess. Again, it is contemplated that a planing type device may be run along the surface 260 to trim the seal member down to a specified, desired height. Moreover, the seal member 304 is applied so that gaps 311 are formed, into which the seal member can compress during mating of liner plate structures. As shown, a sub-recess 312 runs alongside the recess 302 at the radially inward facing side and forms both a repair channel into which grout or other sealant can be placed as described above. The sub-recess 302 also forms a possible expansion space.

In this regard, reference is made to FIG. 37 where two mated flanges 300 are shown with respective seal members 304 in mating contact and compressed so as to fill substantially the entire recess 302. For the purpose of secondary grout sealing, radially extending sub-recess portions 314 may be provided. Prior to joining two liner plate structures together, a chemical weld activator coating may be applied to the outwardly facing surface of each seal member 304 so that when the two seal members engage each other they become welded together, further enhancing the seal effect.

Also shown in FIG. 37 is a further seal enabling structure of the liner plate system. Specifically, at least one of the upper and lower flanges and at least one of the right and left flanges of each liner plate structure may be formed with a recessed portion 316 (e.g., a chamfer) along its radially inward edge such that, when liner plate structures are joined together, a weld recess 318 is formed to facilitate application of a metallurgical weld between the plate structures if necessary or desired.

While particular embodiments have been illustrated and described, it is to be clearly understood that the above description is intended by way of illustration and example only and is not intended to be taken by way of limitation, and that changes and modifications are possible.

What is claimed is:

1. A method of forming a plate structure for use in lining shafts and tunnels, comprising:

utilizing a liner plate structure with a primary plate having first, second, third and fourth flanges respectively disposed at first, second, third and fourth side edges of the primary plate, each flange including a respective recess that is aligned with the recess of adjacent flanges to produce a continuous recess that circumscribes the liner plate structure;

applying a seal member to the continuous recess utilizing a plural component material processing technique and in a manner such that the seal member at least partially cures within the recess and is bonded to a portion of the recess and includes an upper portion protruding from the recess;

wherein subsequent to the applying step a planing device is used to cut the seal material in order to define a final height of the seal member.

2. The method of claim 1 wherein the applying step involves an impingement mix spray process.

3. The method of claim 1 wherein the applying step involves a static mix injection process.

4. The method of claim 1 wherein prior to the applying step the recess is prepared by an abrading step.

5. The method of claim 4 wherein the abrading step is an abrasive blast spray process.

6. The method of claim 1 wherein the seal member applied via the plural component material processing technique is a polyurethane or polyurea compound.

7. The method of claim 1 wherein seal member applied via the plural component processing technique is formed by the combination of an isocyanate and one or more of an alcohol, a hydroxyl, a polyol or an amine.

8. A method of forming a plate structure for use in lining shafts and tunnels, comprising:

utilizing a liner plate structure with a primary plate having first, second, third and fourth flanges respectively disposed at first, second, third and fourth side edges of the primary plate, each flange including a respective recess that is aligned with the recess of adjacent flanges to produce a continuous recess that circumscribes the liner plate structure;

applying a seal member to the continuous recess utilizing a plural component material processing technique and in a manner such that the seal member at least partially cures within the recess and is bonded to a portion of the recess and includes an upper portion protruding from the recess;

wherein during the applying step one or more seal forms are located alongside and/or within the recess to define lateral limits for the applied seal member, and wherein the seal forms are removed after application of the seal member.

9. The method of claim 8 wherein subsequent to the applying step a planing device is used to cut the seal material in order to define a final height of the seal member.

10. A method of forming a plate structure for use in lining shafts and tunnels, comprising:

utilizing a liner plate structure with a primary plate having first, second, third and fourth flanges respectively disposed at first, second, third and fourth side edges of the primary plate, each flange including a respective recess that is aligned with the recess of adjacent flanges to produce a continuous recess that circumscribes the liner plate structure;

abrading at least a bottom surface of the continuous recess to prepare the continuous recess to receive a seal material;

applying a seal material to the continuous recess utilizing a plural component material processing technique such that the seal material at least partially cures within the recess and bonds to the bottom surface of the recess and includes an upper portion protruding from the recess;

wherein during the applying step one or more seal forms are located alongside and/or within the recess to define lateral limits for the applied seal material, and wherein the seal forms are removed after application of the seal member.

11. The method of claim 10 wherein the seal material applied via the plural component material processing technique is a polyurethane or polyurea compound.

12. The method of claim 11 wherein the applying step involves an impingement mix spray process.

13. The method of claim 10 wherein the recess includes a sub-recess adjacent thereto, the sub-recess having a depth that is less than a depth of the recess, and during the applying step at least one seal form is positioned to prevent seal material from being applied in the sub-recess.

14. The method of claim 13 wherein during the applying step seal forms are positioned within the recess such that the seal material is not applied to sidewalls of the recess.

15. The method of claim 12 wherein subsequent to the applying step a planing device is used to cut the seal material in order to define a final height of seal material protruding from the recess.

16. The method of claim 12 wherein the abrading step is an abrasive blast spray process.

* * * * *